US005651342A

United States Patent [19]

Hara

[11] Patent Number: 5,651,342

[45] Date of Patent: Jul. 29, 1997

[54] AUXILIARY AIR FLOW CONTROL SYSTEM FOR INTERNAL COMBUSTION ENGINES

[75] Inventor: Kenji Hara, Fujisawa, Japan

[73] Assignee: Nissan Motor Co., Ltd., Kanagawa, Japan

[21] Appl. No.: 667,273

[22] Filed: Jun. 20, 1996

[30] Foreign Application Priority Data

Jun. 22, 1995 [JP] Japan ..... 7-156086

[51] Int. Cl.[6] ..... F02M 3/00

[52] U.S. Cl. ..... 123/339.24; 123/339.1

[58] Field of Search ..... 123/339.24, 339.1, 123/585, 588, 339.22, 339.23, 589, 587

[56] References Cited

U.S. PATENT DOCUMENTS

| | | | |
|---|---|---|---|
| 4,364,348 | 12/1982 | Itoh et al. | 123/339.24 |
| 4,672,936 | 6/1987 | Abe | 123/339.24 |
| 4,690,121 | 9/1987 | Kawanabe et al. | 123/589 |
| 5,007,396 | 4/1991 | Wellenkotter et al. | 123/339.24 |
| 5,048,483 | 9/1991 | Nakazawa | 123/339.24 |
| 5,353,776 | 10/1994 | Burrahm et al. | 123/585 |
| 5,417,195 | 5/1995 | Tachikawa et al. | 123/585 |

FOREIGN PATENT DOCUMENTS

| | | | |
|---|---|---|---|
| 62-119446 | 7/1987 | Japan | 123/339.24 |

*Primary Examiner*—Raymond A. Nelli
*Attorney, Agent, or Firm*—Lowe, Price, LeBlanc & Becker

[57] ABSTRACT

An auxiliary air flow control system for an internal combustion engine, comprises an auxiliary air passage arranged parallel to an intake-air passage and bypassing a throttle valve disposed in the intake-air passage for diverting a part of intake air from an upstream side of the throttle valve to a downstream side of the throttle valve, an auxiliary air flow control valve disposed in the auxiliary air passage and responsive to operating conditions of the engine for producing therethrough a controlled flow rate of the auxiliary air, and an auxiliary air flow constricting valve sensitive to an engine coolant temperature for constricting the controlled flow rate of the auxiliary air from the auxiliary air flow control valve. The auxiliary air flow constricting vane has a substantially V-shaped coolant-temperature versus auxiliary air-flow constriction characteristic. According to this characteristic, the flow rate of auxiliary air is gradually decreased owing to a coolant-temperature rise when the coolant temperature is below a first predetermined temperature, and gradually increased owing to the temperature rise when the coolant temperature is below a second predetermined temperature, and held constant within a predetermined temperature range of the first and second predetermined temperatures.

9 Claims, 6 Drawing Sheets

AUXILIARY AIR FLOW CONTROL SYSTEM FOR INTERNAL COMBUSTION ENGINES

BACKGROUND OF THE INVENTION

1. Field of the Invention

The present invention relates to an auxiliary air flow control system suitable for use in internal combustion engines, and more specifically to a system equipped with an auxiliary air flow constriction structure which is capable of optimally constricting a controlled air flow produced by an auxiliary air flow control valve, depending on changes in the engine temperature.

2. Description of the Prior Art

In recent years, to suit different operating conditions of the engine, there have been proposed and developed various auxiliary air flow control systems for internal combustion engines. The typical auxiliary air flow control system has at least an electronically-controlled auxiliary air flow control valve whose opening degree is electronically controlled in response to a control signal from a control unit which unit usually employs an input interface connected to sensors for monitoring operating conditions of the engine such as engine load, engine speed and the like, and a cooling-water temperature dependent auxiliary air flow constricting valve whose opening degree is controlled depending on the cooling-water temperature (called engine coolant temperature). For this purpose, the latter valve (the cooling-water temperature dependent auxiliary air flow constricting valve) has a temperature-sensing portion for sensing a temperature of cooling water which circulates in a water jacket in the engine. The cooling water temperature is usually regarded as an engine temperature. Ordinarily, the auxiliary air flow control valve and the auxiliary air flow constricting valve are fluidly disposed in series to each other in an auxiliary air passage arranged parallel to the intake-air passage passing through the throttle valve, so that the auxiliary air flow control valve is arranged upstream of the auxiliary air flow constricting valve. The auxiliary air passage is connected to the intake-air passage in such a manner as to bypass the throttle valve for the purpose of diverting intake air from the upstream of the throttle valve to the downstream of the throttle valve therethrough. A flow rate of auxiliary air, passing through the auxiliary air flow control valve, is properly adjusted in dependent on the engine operating conditions, and then the properly controlled auxiliary air flow is constricted by means of the auxiliary air flow constricting valve depending on the engine temperature. The previously-noted constriction or adjustment of auxiliary air flow is effective to maintain the engine speed at a predetermined engine speed during idling. One such conventional auxiliary air flow control system has been disclosed in Japanese Utility Model Provisional Publication No. 62-119446. The auxiliary air flow constricting valve employed in the prior art system as described in the Japanese Utility Model Provisional Publication No. 62-119446 has a typical characteristic of coolant-temperature versus auxiliary air-flow constriction, in which characteristic a constricting amount of auxiliary air flow is gradually increased in accordance with an increase in coolant temperature sensed by a temperature-sensing portion incorporated into the auxiliary air flow constricting valve, and held constant after the sensed coolant temperature reaches and exceeds a predetermined temperature, i.e., after warm up of the engine. In other words, according to the above-mentioned typical coolant-temperature versus auxiliary air-flow constriction characteristic, the total flow rate of auxiliary air flowing through the auxiliary air passage (or the by-pass passage) is gradually decreased (essentially in a linear fashion) during cold-engine operation and then held constant after warm-up, as indicated by one-dotted line of FIG. 2. The prior art auxiliary air flow control system suffers from the following drawback. That is, in the event that the engine temperature (the coolant-temperature) rises and exceeds the predetermined water temperature, the temperature of intake air rises and thus the air density tends to be lowered. In this case, with respect to engine load actually applied, a required air flow rate must be increased owing to the lowering of air density. However, in the case of the conventional auxiliary air flow constricting valve having the previously-noted coolant-temperature versus auxiliary air-flow constriction characteristic, the constricting amount of auxiliary air flow is held constant within a high-temperature range above the predetermined temperature. This could result in lack of auxiliary air flow. Thus, there is a possibility that the prior art system does not satisfactorily maintain a target idle speed owing to the lack of auxiliary air flow at high coolant temperatures above the predetermined temperature. During operation of the prior art system within the high-temperature range, there is a tendency that the engine speed tends to drop in comparison with the target idle speed during idling.

SUMMARY OF THE INVENTION

Accordingly, it is an object of the invention to provide an improved auxiliary air flow control system for internal combustion engines which avoids the foregoing disadvantages of the prior art.

It is another object of the invention to provide an auxiliary air flow control system for internal combustion engines, which can eliminate lack of auxiliary air flow even at high engine temperatures and maintain an engine speed at a predetermined target idle speed during idling without being affected by lowering of air density resulting from a temperature rise in intake-air to be introduced into the intake valve port, by improving a coolant-temperature versus auxiliary air-flow constriction characteristic of an auxiliary air flow constricting valve employed in the system.

In order to accomplish the aforementioned and other objects of the invention, an auxiliary air flow control system for an internal combustion engine, comprises an auxiliary air passage arranged parallel to an intake-air passage and bypassing a throttle valve disposed in the intake-air passage, for diverting a part of intake air from an upstream side of the throttle valve to a downstream side of the throttle valve as an auxiliary air, an auxiliary air flow control valve disposed in the auxiliary air passage and responsive to operating conditions of the engine for producing therethrough a controlled flow rate of the auxiliary air, auxiliary-air-flow constricting means being sensitive to a coolant temperature of engine coolant circulating the engine, for constricting the controlled flow rate of the auxiliary air from the auxiliary air flow control valve, and the auxiliary-air-flow constricting means having a valve structure in which a constricting amount of the auxiliary air is increased in accordance with an increase in the coolant temperature when the coolant temperature is below a first predetermined temperature, and held at a predetermined maximum constricting amount when the coolant temperature is within a predetermined temperature range defined by the first predetermined temperature and a second predetermined temperature greater than the first predetermined temperature, and decreased from the predetermined maximum constricting amount in accordance with the increase in the coolant temperature when the coolant temperature rises greater than the second predetermined temperature.

The auxiliary-air-flow constricting means may comprise a pair of parallel branch passages which passages are branched from the auxiliary air passage downstream of the auxiliary air flow control valve and connected in common to the intake-air passage downstream of the throttle valve, and a pair of auxiliary air flow constricting valves fluidly disposed in the respective branch passages. In this case, a first flow constricting valve of the auxiliary air flow constricting valves has a coolant-temperature versus auxiliary air-flow constriction characteristic according to which a constricting amount of auxiliary air flowing through the first flow constricting valve is increased in accordance with the increase in the coolant temperature until the first predetermined temperature has been reached, and held constant at a first predetermined maximum constricting amount after the first predetermined temperature has been reached. On the other hand, a second flow constricting valve of the auxiliary air flow constricting valves has a coolant-temperature versus auxiliary air-flow constriction characteristic according to which a constricting amount of auxiliary air flowing through the second flow constricting valve is held constant at a second predetermined maximum constricting amount until the second predetermined temperature has been reached, and increased in accordance with the increase in the coolant temperature after the second predetermined temperature has been reached. It is preferable that the constricting amount of auxiliary air flowing through the first flow constricting valve is increased linearly in accordance with the increase in the coolant temperature until the first predetermined temperature has been reached, and the constricting amount of auxiliary air flowing through the second flow constricting valve is increased linearly in accordance with the increase in the coolant temperature after the second predetermined temperature has been reached. Alternatively, the auxiliary-air-flow constricting means may comprise a single auxiliary air flow constricting valve fluidly disposed in the auxiliary air passage downstream of and in series to the auxiliary air flow control valve. The single auxiliary air flow constricting valve may preferably include a wax-pellet type temperature-sensitive valve.

DESCRIPTION OF THE PREFERRED EMBODIMENTS

First embodiment

Figure 1:
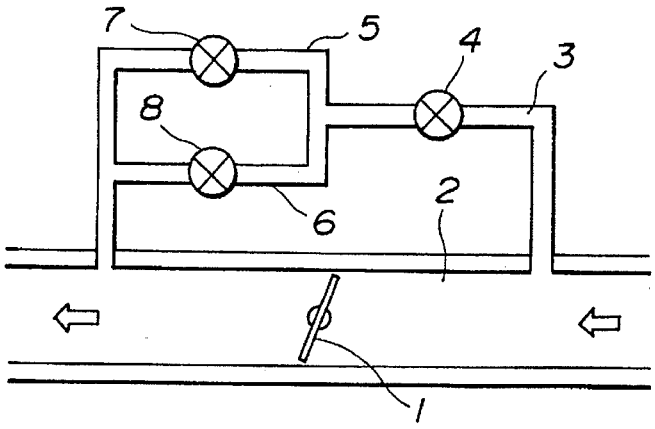
FIG. 1 is a schematic system diagram illustrating a first embodiment of an auxiliary air flow control system made according to the present invention.
Figure 2:
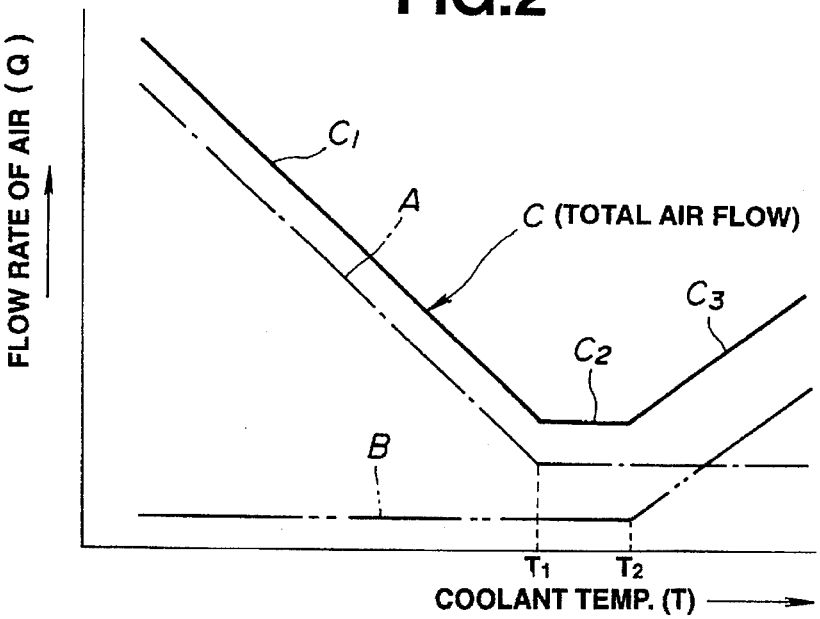
FIG. 2 is a graph illustrating a characteristic of coolant-temperature versus auxiliary air flow constriction, achieved by an auxiliary air flow constricting valve employed in the auxiliary air flow control system of the first embodiment.

Referring now to the drawings, particularly to FIGS. 1 and 2, the auxiliary air flow control system of the first embodiment includes an auxiliary air passage 3 which is provided to by-pass intake air from the upstream of a throttle valve 1 to the downstream. The auxiliary air passage 3 is arranged parallel to an intake-air passage 2 passing through the throttle valve 1. An electronically-controlled auxiliary air flow control valve 4 is fluidly disposed in the auxiliary air passage 3. In a conventional manner, the opening degree of the auxiliary air flow control valve 4 is electronically controlled in response to a control signal from a control unit (not shown). Usually, the control unit at least has an input interface connected to a plurality of sensors for monitoring operating conditions of the engine such as engine load, engine speed and the like, a processor for processing signals from the sensors, and an output interface outputting the control signal processed through the processor. As seen in FIG. 1, the auxiliary air passage 3 is divided or branched into two branch passages 5 and 6 downstream of the auxiliary air flow control valve 4, so that the branch passages 5 and 6 are arranged parallel to each other. The branch passages 5 and 6 are both connected in common to the intake-air passage downstream of the throttle valve 1. First and second auxiliary air flow constricting or restricting valves 7 and 8 are fluidly disposed in the respective branch passages 5 and 6. The two auxiliary air flow constricting valves 7 and 8 are provided to properly constrict the flow rate of auxiliary air flowing through and properly adjusted by the auxiliary air flow control valve 4 in accordance with their coolant-temperature versus auxiliary airflow constriction characteristics. Each of the auxiliary air flow constricting valves 7 and 8 is comprised of a cooling-water temperature dependent auxiliary air flow constricting valve or a coolant-temperature sensitive auxiliary air flow constricting valve whose opening degree can be adjusted depending on the coolant temperature sensed by a temperature sensing portion (temperature-sensitive portion) incorporated in the auxiliary air flow constricting valve. The coolant-temperature sensitive auxiliary air flow constricting valve usually consists of a bimetal type temperature-sensitive valve or a wax-pellet type temperature-sensitive valve. Note that the coolant-temperature versus auxiliary air-flow constriction characteristic of the first auxiliary air flow constricting valve 7 is different from that of the second auxiliary air flow constricting valve 8. That is, the first auxiliary air flow constricting valve 7 exhibits a coolant-temperature versus auxiliary air-flow constriction characteristic as indicated by the one-dotted line A of FIG. 2, similar to the characteristic of the prior art auxiliary air flow constricting valve. According to the characteristic of the first flow constricting valve 7, a constricting amount of auxiliary air flowing through the first flow constricting valve 7 is gradually increased in accordance with the increase in the coolant temperature sensed until the coolant temperature reaches a first predetermined temperature T1, and held at a first predetermined maximum constricting amount of auxiliary air flow after the sensed coolant temperature exceeds the first predetermined temperatures T1. On the other hand, the second flow constricting valve 8 exhibits a coolant-temperature versus auxiliary air flow constricting characteristic as indicated by the two-dotted line B of FIG. 2. According to the characteristic of the second flow constricting valve 8, a constricting amount of auxiliary air flowing through the second flow constricting valve 8 is held until the coolant temperature sensed reaches a second predetermined temperature T2 slightly greater than the first predetermined temperature T1, and gradually decreased in accordance with the increase in the coolant temperature after the sensed coolant temperature exceeds the second predetermined temperature T2. In the shown embodiment, the flow rate of auxiliary air flowing through the first flow constricting valve 7 is decreased to a first predetermined minimum flow rate (corresponding to the above-noted first predetermined maximum constricting amount) until the sensed coolant temperature reaches the first predetermined temperature T1, and held at the first predetermined minimum flow rate after the sensed coolant temperature exceeds the first predetermined temperature T1 whereas the flow rate of auxiliary air flowing through the second flow constricting valve 8 is held constant, that is, at a second predetermined minimum flow rate (corresponding to the above-noted second predetermined maximum constricting amount) until the sensed coolant temperature reaches the second predetermined temperature T2, and gradually increased in accordance with the increase in the coolant temperature after the sensed coolant temperature exceeds the second predetermined temperature T2. The auxiliary air flow constricted through the first flow constricting valve 7 and the auxiliary air flow constricted through the second flow constricting valve 8 are summed up at a confluent point of the two branch passages 5 and 6, which confluent point connected to the intake-air passage downstream of the throttle valve 1. As a consequence, the first and second flow constricting valves 7 and 8 are cooperative to each other to provide a substantially V-shaped coolant-temperature versus auxiliary air-flow constriction characteristic (the relationship between coolant temperature and the total auxiliary air flow rate) as indicated by the solid line C of FIG. 2, which solid line is constructed by three line segments C1, C2 and C3. As can be appreciated from the above-noted total auxiliary air flow rate characteristic indicated by the solid line C, namely the line segments C1, C2, and C3, in the flow constricting valves 7 and 8 employed in the system of the first embodiment, when the sensed coolant temperature T is equal to or less than the first predetermined temperature T1, i.e., in case of $T \leqq T1$ (see the line segment C1 of FIG. 2), the total flow rate Q of auxiliary air decreases in a linear fashion in accordance with the increase in the coolant temperature T. When the sensed coolant temperature T is greater than the first predetermined temperature T1 and equal to or less than the second predetermined temperature T2, i.e., in case of $T1<T \leqq T2$ (see the line segment C2 of FIG. 2), the total flow rate Q of auxiliary air is held at the sum of the previously-noted first and second predetermined minimum flow rates. When the sensed coolant temperature T exceeds the second predetermined temperature T2, i.e., in case of $T2<T$ (see the line segment C3 of FIG. 2), the total flow rate of auxiliary air increases again in a linear fashion in accordance with the increase in the coolant temperature T. The auxiliary air flow constricting valve employed in the system made in accordance with the invention and having the above-noted V-shaped coolant-temperature versus auxiliary air-flow constriction characteristic can effectively avoid lack of auxiliary air flow even at high coolant temperatures above the second predetermined temperature T2, and maintain the engine speed at a target idle speed during idling within a high engine temperature range, whereas hitherto the flow constricting valve employed in the prior art system exhibits a substantially L-shaped coolant-temperature versus auxiliary air flow constriction characteristic according to which the engine speed tends to drop unintendedly during idling.

Second Embodiment

Figure 3:
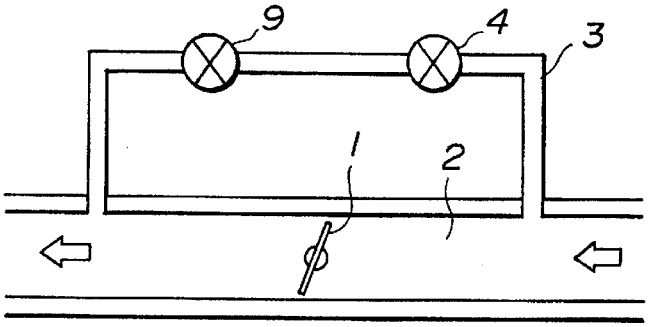
FIG. 3 is a schematic system diagram illustrating a second embodiment of an auxiliary air flow control system made according to the invention.

Referring now to FIG. 3, there is shown the second embodiment of the auxiliary air flow control system. The basic construction of the system of the second embodiment as shown in FIG. 3 is similar to that of the first embodiment as shown in FIG. 1. Therefore, the same reference numerals used in the first embodiment of FIG. 1 will be applied to the corresponding elements used in the second embodiment of FIG. 3, for the purpose of comparison between the first and second embodiments. The second embodiment is different from the first embodiment in that only one auxiliary air flow constricting valve 9 provides the same function as the first and second flow constricting valves 7 and 8 employed in the system of the first embodiment. As seen in FIG. 3, the single auxiliary air flow constricting valve 9 is fluidly disposed in the auxiliary air passage 3 downstream of the auxiliary air flow control valve 4. In the second embodiment, the auxiliary air flow constricting valve 9 is comprised of a wax-pellet type temperature-sensitive valve. Alternatively, the flow constricting valve 9 may be comprised of a bimetal type temperature-sensitive valve. In FIGS. 1 and 3, the arrows indicate the flow of intake air. A portion of the intake air is introduced into the auxiliary air passage 3, and properly constricted as explained above. The structure of the flow constricting valve 9 of the system of the second embodiment will be hereinafter more fully described later.

Figure 4:
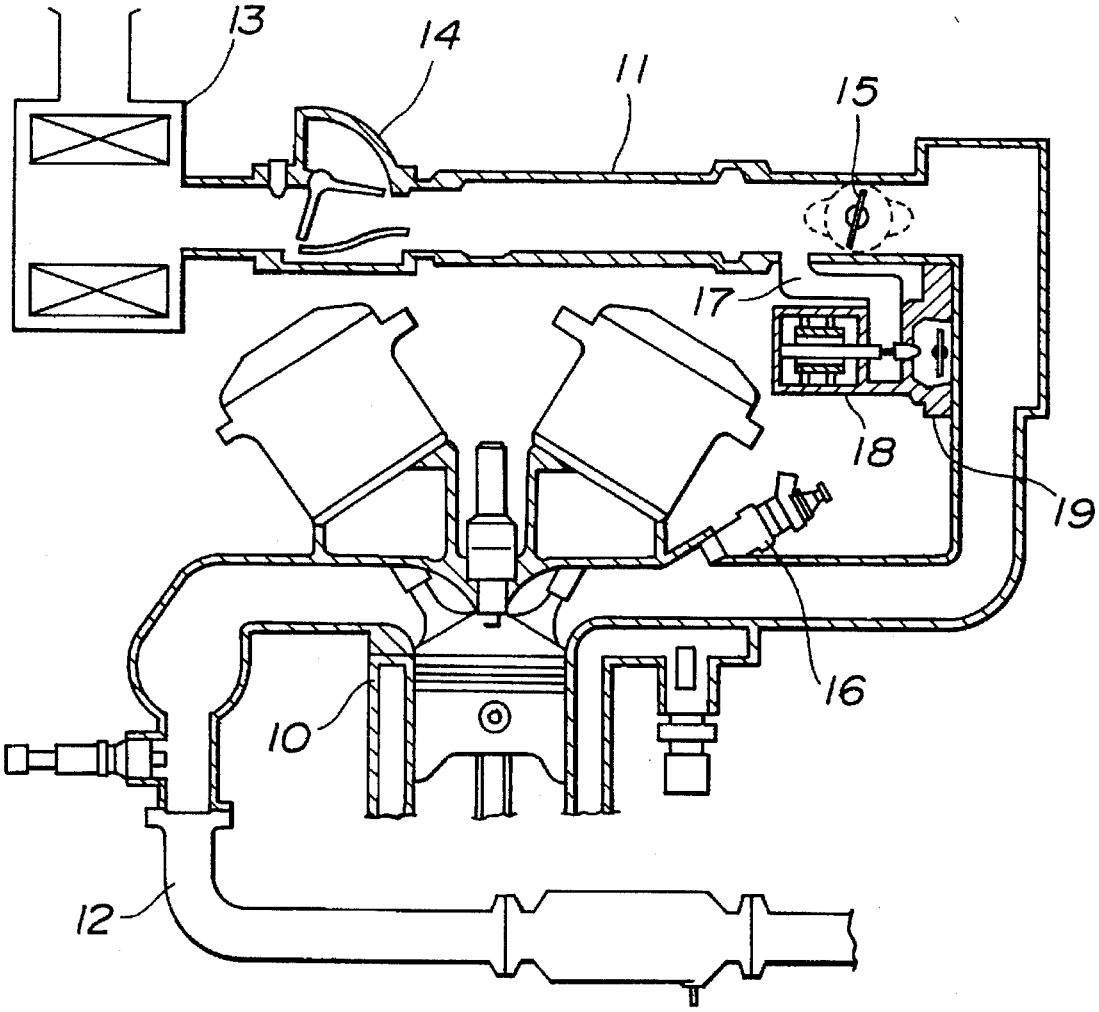
FIG. 4 is a system diagram illustrating a detailed structure of the auxiliary air flow control system of the second embodiment.

Referring now to FIGS. 4 to 7, particularly to FIG. 4, the engine body 10 is equipped with an intake-air tube 11 serving as an intake-air passage and an exhaust pipe 12 serving as an exhaust-gas flow passage. As seen in FIG. 4, an air cleaner 13 is connected through an air flow meter, the intake-air tube 11, a throttle valve 15, an intake manifold (not numbered) to the respective intake-valve ports. Reference numeral 16 denotes a fuel injection valve inserted into the intake manifold so that its nozzle is directed towards the associated intake-valve port. An auxiliary air conduit 17, serving as the previously-noted auxiliary air passage 3, is provided to divert a part of the intake air introduced into the upstream side of the throttle valve 15 to the downstream side of the throttle valve 15. The auxiliary air conduit 17 serves as a by-pass passage by-passing from the upstream side of the throttle valve 15 to the downstream side of the throttle valve 15. Disposed in the auxiliary air conduit 17 is an auxiliary air flow control valve 18 corresponding to the previously-noted electronically-controlled auxiliary air flow control valve 4. Disposed in the auxiliary air conduit 17 downstream of the auxiliary air flow control valve 18 is a wax-pellet type coolant-temperature sensitive auxiliary air flow constricting valve corresponding to the previously-noted auxiliary air flow constricting valve 9.

Figure 5:
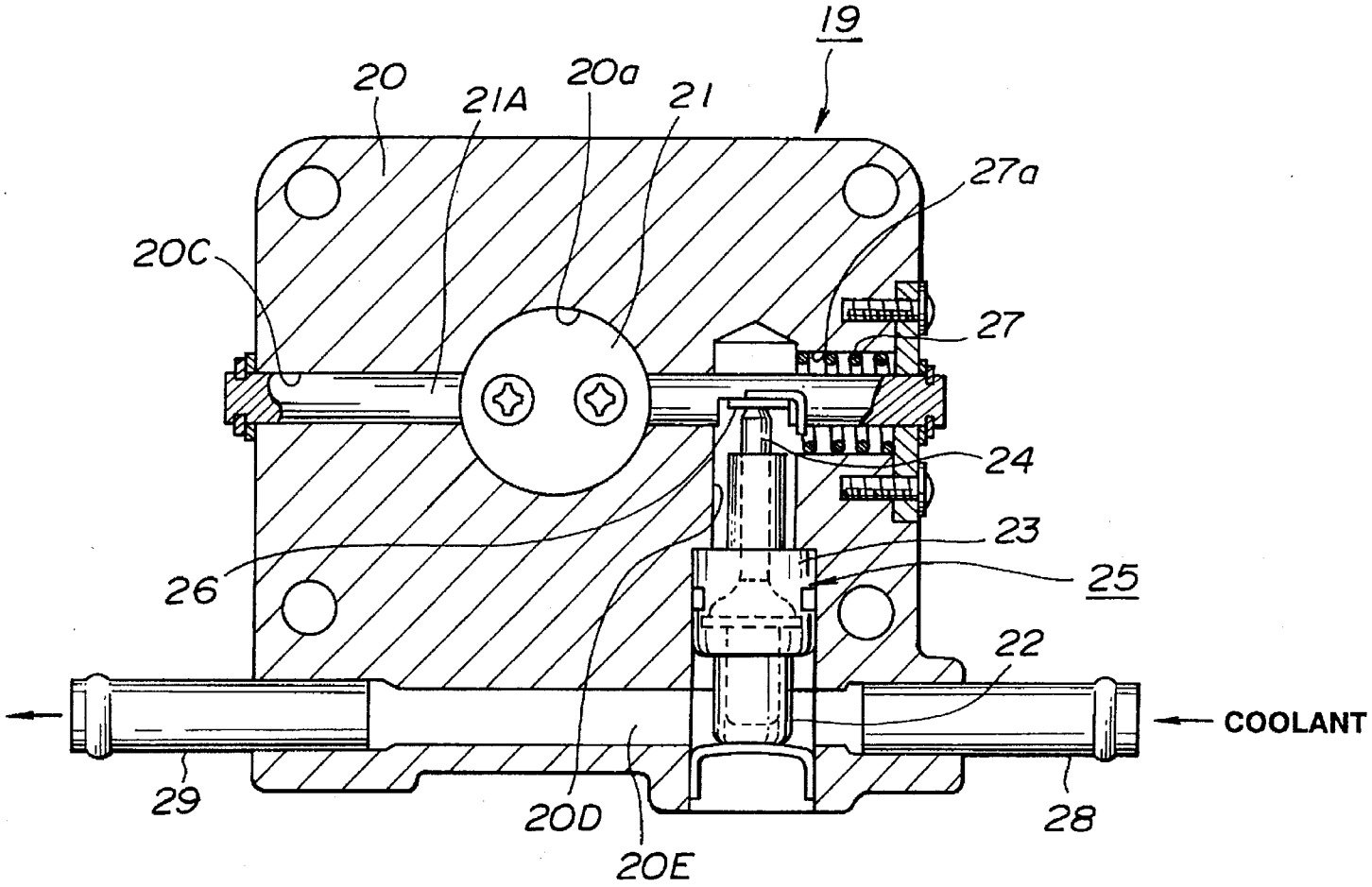
FIG. 5 is an elevational view illustrating the auxiliary air flow constricting valve employed in the system of the second embodiment, cross-sectioned.
Figure 6:
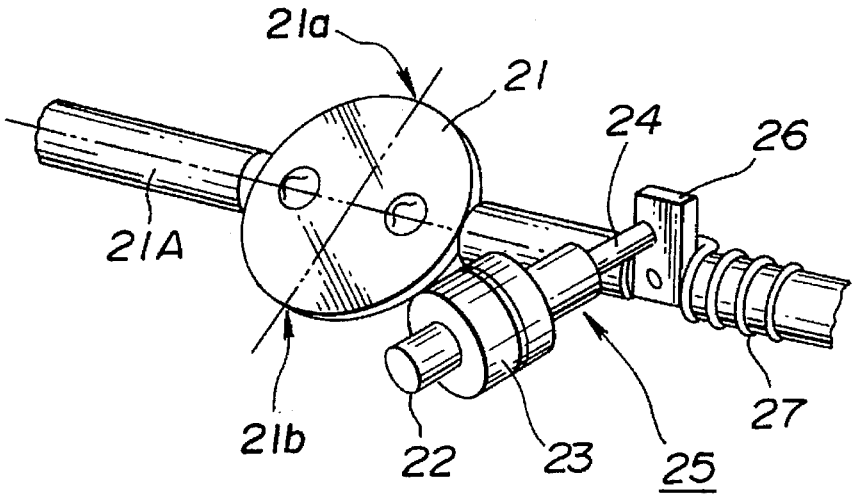
FIG. 6 is a perspective view illustrating the relationship between a round-disc shaped valve member of the auxiliary air flow constricting valve and its valve actuating device.

As detailed in FIG. 5, the auxiliary air flow constricting valve 19 includes a valve housing 20, a round-disc shaped valve 21 similar to a butterfly-type throttle valve, and a valve actuating unit or device 25. The valve actuating unit 25 is comprised of a temperature-sensitive portion 22, an expandable and contractible wax-pellet/diaphragm portion 23 and an axially-movable piston rod or push rod 24 connected to the diaphragm of the wax-pellet/diaphragm portion 23. The wax-pellet/diaphragm portion 23 serves as a push-rod position control portion or a rod-position adjustment portion. In the shown embodiment, the push rod 24 is further projected outside of the wax-pellet/diaphragm portion 23 in accordance with the increase in the sensed coolant temperature and gradually retracted towards the interior of the wax-pellet/diaphragm portion 23 in accordance with the decrease in the sensed coolant temperature. As can be appreciated from the drawings, and specifically from FIG. 7, the valve housing 20 is formed with a fluid-flow passage 20A communicating with the auxiliary air conduit 17. The valve housing 20 is also formed with a substantially annular throttling portion or a substantially annular flow constricting portion 20B having an inner spherical wall surface (spherical zone) 20*a* of a diameter slightly greater than the outside diameter of the round-disc-shaped valve 21 and smaller than the inner diameter of the unconstrictive portion of the fluid flow passage 20A. As clearly seen in FIG. 5, the annular flow constricting portion 20B is circular in cross-section. A valve shaft 21A is rotatably provided in the fluid flow passage 20A defined in the valve housing 20 so that the shaft 21A is in alignment with the spherical zone 20*a* with respect to a direction perpendicular to the axial direction of the passage 20A and so that the axis of the shaft 21A extends perpendicularly to the central axis of the substantially cylindrical fluid flow passage 20A and penetrates the center of the sphere defining the spherical zone 20*a*. As may be appreciated from FIGS. 5 and 6, the round-disc shaped valve 21 is firmly secured to the shaft 21A by means of screws for co-rotation with the shaft 21A. As best seen in FIG. 5, the shaft 21A is rotatably supported by means of a pair of diametrically-opposed lateral bores 20C which extend perpendicularly to the central axis of the fluid flow passage 20A and defined in the housing 20 in such a manner that two diametrically-opposed inside ends of the bores 20C expose to the fluid flow passage 20A and that the outside ends of the bores 20C expose towards the exterior of the housing 20. The right-hand bore 20C is partially diametrically enlarged at its outside end. Reference numeral 27*a* denotes the diametrically-enlarged bore section. The shaft 21A is rotatably supported by the lateral bores 20C while preventing the axial movement of the shaft 21A by way of snap rings snapped back toward their unstressed positions into respective annular grooves formed on the outer peripheries of both ends of the shaft 21A. As seen in FIGS. 5 and 6, a cam plate 26 is firmly mounted on the shaft 21A, in a manner so as to provide a cam connection with the push rod 24 of the valve actuating unit 25. An annular space is defined between the outer peripheral surface of the shaft 21A and the diametrically-enlarged bore section 27*a*. A coiled return spring 27, serving as a torsion spring, is operatively disposed in the above-noted annular space. As seen in FIG. 5, one surface (the lower surface) of the cam plate 26 is in cam-contact with the substantially semi-spherical tip end of the push rod 24 of the valve actuating unit 25, another surface (the upper surface) of the cam plate 26 is engaged with one armed end of the return spring 27. The other armed end of the return spring 27 is firmly connected to a lid (not numbered) which is provided for hermetically covering the essentially annular right-hand side opening of the diametrically-enlarged bore section 27*a*. By way of the above-noted return spring, the shaft 21A is turned to its spring-loaded position. With the shaft 21A held at the spring-loaded position and the wax pellet shrunk in the wax-pellet/diaphragm portion 23, the round-disc shaped valve 21 is located at an angular position a indicated by the broken line of FIG. 7. In FIG. 5, reference numeral 20D denotes a mounting bore for the valve actuating unit 25. The mounting bore 20D is defined in the housing 20 in a manner so as to extend in a direction perpendicular to the central axis of the shaft 21A and to be aligned with the cam plate 26 attached to the valve shaft 21A. A coolant passage 20E is defined in the housing 20 to be crossed to the bore 20D. Both ends of the coolant passage 20E is connected to both a coolant inlet tube 28 and a coolant outlet tube 29. When assembling, the valve actuating unit 25 is inserted through the bottom opening end of the bore 20D and further inserted until the tip end of the push rod 24 is brought into light-contact with the cam plate 26 and thus press-fitted into a predetermined position. Then, the bottom opening end of the bore 20D is hermetically sealed in a fluid-tight fashion by means of a plug (not numbered and inversed U-shaped in cross-section). As seen in FIG. 5, the temperature-sensitive portion 22 is exposed to the coolant flow in the passage 20E. Although it is not clearly shown, a seal such as an O ring is provided between the outer periphery of the wax-pellet/diaphragm portion 23 and the inner periphery of the bore 20D to provide a fluid-tight seal. With the previously-noted arrangement, the auxiliary air flow constricting valve 19 operates as follows.

Figure 7:
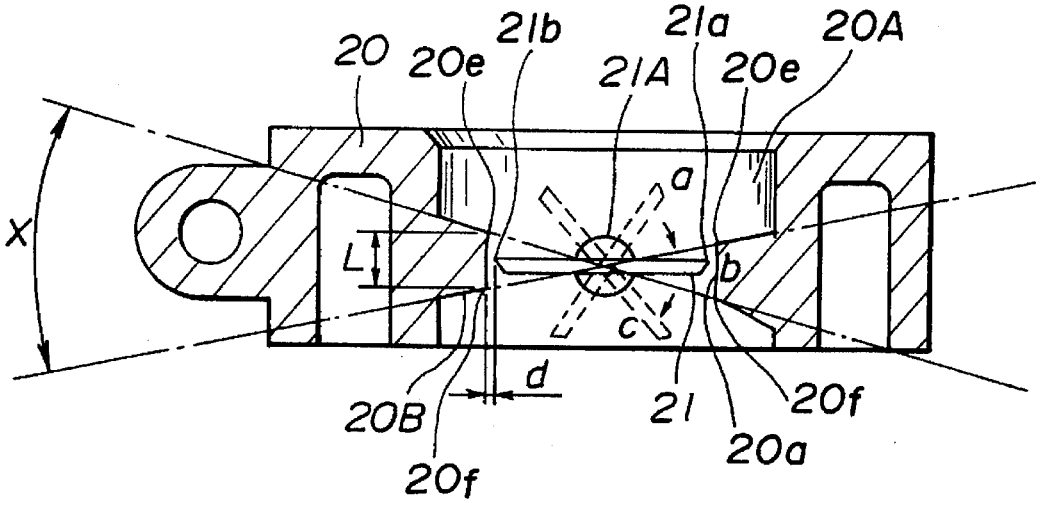
FIG. 7 is a longitudinal cross-sectional view of the auxiliary air flow constricting valve, taken along the central axis of the auxiliary air passage defined in the valve.

At the beginning of cold-engine operation when the coolant temperature T sensed by the temperature-sensing portion 22 is considerably lower than the first predetermined temperature T1, the wax pellet in the wax-pellet/diaphragm portion 23 shrinks such that the valve 21 is located substantially in the spring-loaded position (corresponding to the angular position a of FIG. 7). Under this condition, when the sensed temperature T gradually rises towards the first predetermined temperature T1, the wax pellet in the wax-pellet/diaphragm portion 23 gradually expands in accordance with the increase in the sensed coolant temperature T, and thus the cam plate 26 is pushed by way of the tip end of the push rod 24. As a result, the round-disc shaped valve 21 rotates in its clockwise direction from the angular position a towards the angular position b indicated in FIG. 7. When the edge of the round-disc shaped valve 21 reaches the spherical zone 20*a* of the annular flow constricting portion 20B from the spring-loaded position (the angular position a) by way of the clockwise rotation (viewing FIG. 7) of the valve 21, the valve begins to constrict the auxiliary air flow with the predetermined maximum constricting amount (the predetermined minimum flow rate). As may be appreciated, within the spherical zone 20*a* which can be defined by the predetermined angular range X indicated by the one-dotted lines (crossed to each other) of FIG. 7, the valve 21 is kept at its maximum flow constricting position to ensure the predetermined maximum constricting amount and consequently to provide the maximum constricting effect. The above-mentioned maximum flow constricting amount is determined depending on a radial clearance d which is defined between the inner spherical surface of the spherical zone 20*a* and the outer peripheral edge of the round-disc shaped valve 21. On the other hand, the predetermined angular range X is determined depending on a predetermined distance or length L between upper and lower edges 20*e* and 20*f* of the annular flow constricting portion 20B. In more detail, as seen in FIGS. 6 and 7, there are a pair of diametrically-opposed edge points 21*a* and 21*b* on a perpendicular (indicated by the two-dotted line) with respect to the central axis (indicated by the one-dotted line) of the shaft 21A. Precisely, the above-noted predetermined angular range X is defined as an angle between a line segment which is indicated by the one-dotted line up-sloped to the right-hand side and passes through both the central axis of the shaft 21A and the upper edge 20*e* which is able to be in close proximity to the first edge point 21*a* and a line segment which is indicated by the one-dotted line down-sloped to the right-hand side and passes through both the central axis of shaft 21A and the upper edge 20*e* which is able to be in close proximity to the second edge point 21*b*. In other words, the stroke of the push rod 24 or the angular position of the valve 21 is designed so that the distance between the first edge point 21*a* and the upper edge 20*e* of the spherical zone 20*a* reaches the shortest distance and the position relationship between the first edge point 21*a* and the upper edge 20*e* reaches the angular position indicated by the up-sloped one dotted line of FIG. 7 when the sensed coolant temperature T is the first predetermined temperature T1, and so that the distance between the second edge point 21*a* and the upper edge 20*e* of the spherical zone 20*a* reaches the shortest distance and the position relationship between the second edge point 21*b* and the upper edge 20*e* reaches the angular position indicated by the down-sloped one dotted line of FIG. 7 when the sensed coolant temperature T is the second predetermined temperature T2. The angular position b of the valve 21 indicated by the solid line of FIG. 7 is essentially identical to the intermediate temperature midway between the first and second coolant temperatures T1 and T2. When the coolant temperature exceeds the second coolant temperature T2 and further rises, the valve 21 rotates clockwise from the angular position b towards the angular position c in accordance with the increased stroke of the push rod 24, with the result that the valve 21 begins to go outside of the spherical zone 20*a*. Therefore, when the engine coolant has warmed up sufficiently to temperatures above the second coolant temperature T2, the first edge point 21*a* is positioned at a level below the lower edge 20*f* of the spherical zone 20*a*. In this manner, the opening degree of the valve 21 is gradually decreased according to the increase in the sensed coolant temperature T within the comparatively lower coolant temperature range, that is, in case of $T \leqq T1$, and held constant (at the predetermined minimum flow rate) in case of $T1 < T \leqq T2$, and increased again according to the increase in the sensed coolant temperature T in case of $T2 < T$. Thus, the auxiliary air flow constricting valve 19 shown in FIGS. 5 to 7, can provide the V-shaped coolant-temperature versus auxiliary air-flow constriction characteristic as indicated by the solid line C in FIG. 2, thereby effectively preventing the engine revolution speed from unintendedly dropping even after warm up of the engine. As set forth above, since the auxiliary air flow constricting valve employed in the system of the second embodiment, as indicated in FIGS. 5 through 7, the butterfly-type valve 21 is rotatable by way of the cam connection between the cam plate 26 and the push rod 24 of the wax-pellet type valve actuating unit 25, the entire size of the auxiliary air flow constricting valve assembly is comparatively large.

Figure 8A:
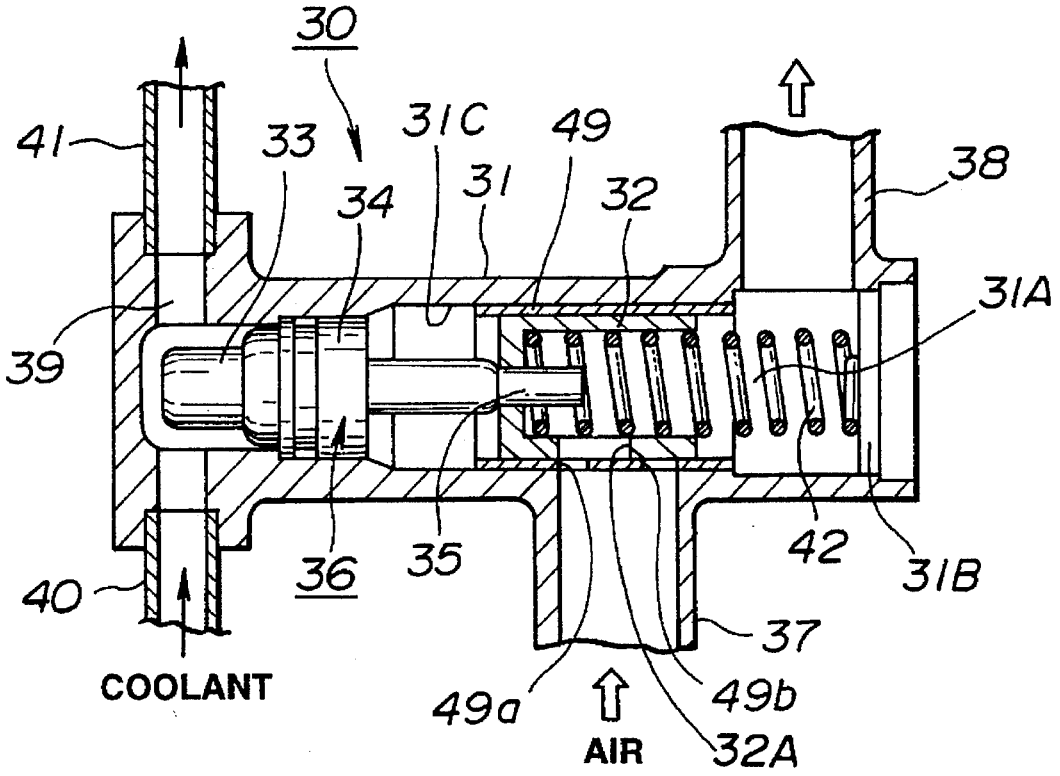
FIG. 8A is a cross-sectional view illustrating a first modification of the auxiliary air flow constricting valve.
Figure 8B:
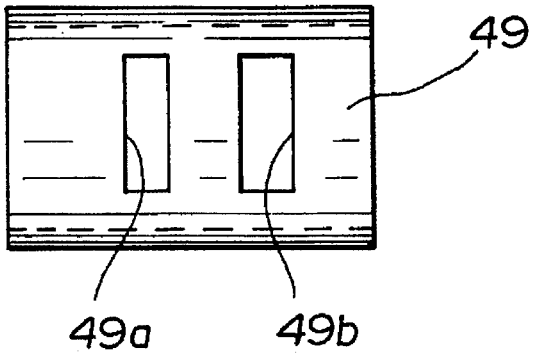
FIG. 8B is a plan view illustrating a guide sleeve for a substantially cylindrical hollow spool employed in the auxiliary air flow constricting valve shown in FIG. 8A.
Figure 9:
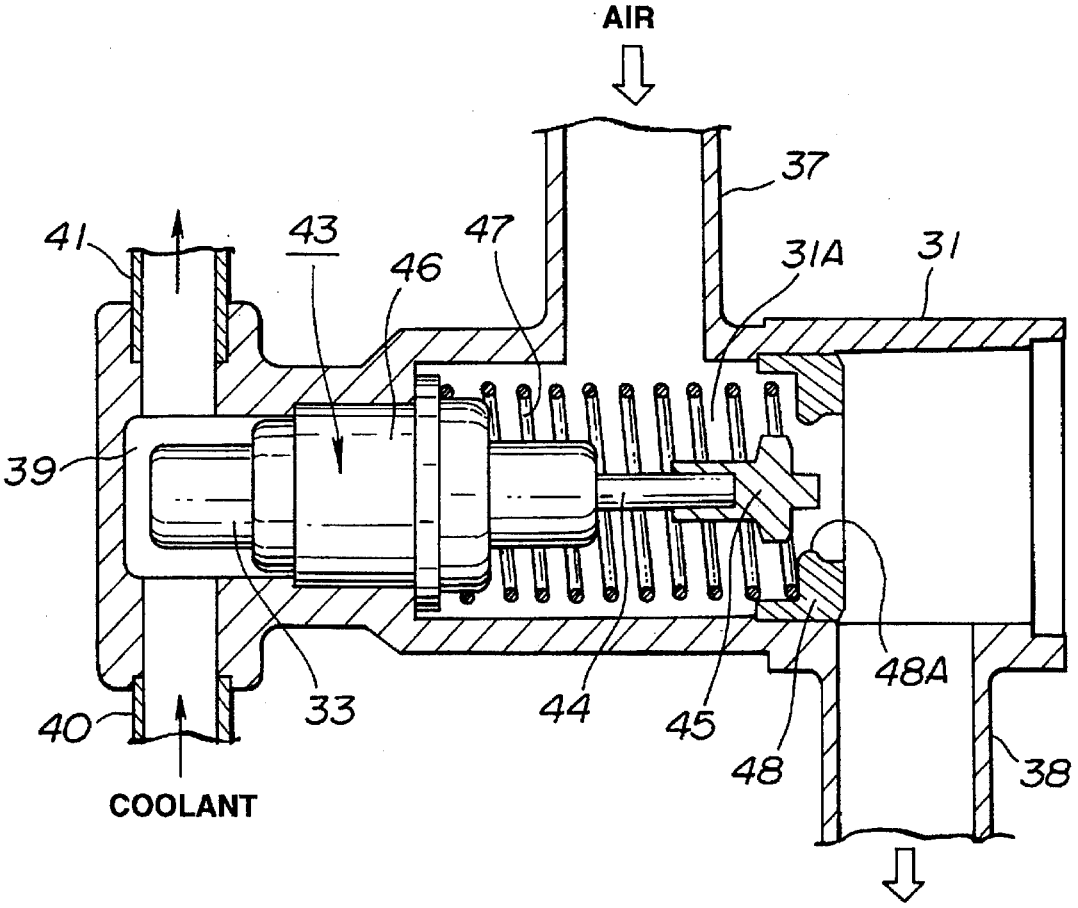
FIG. 9 is a cross-sectional view illustrating a second modification of the auxiliary air flow constricting valve.

Referring now to FIGS. 8A, 8B and 9, there are shown modifications of the auxiliary air flow constricting valve which is applicable to the system of the present invention. In comparison with the flow constricting valve assembly 19 shown in FIGS. 5 through 7, the flow constricting valve 30 of the first modification shown in FIGS. 8A and 8B and the flow constricting valve 43 of the second modification shown in FIG. 9 are different from the valve 19 shown in FIG. 5, in that an axially-slidable valve body (32; 45) is axially aligned with a wax-pellet type valve actuating unit (36; 43).

Referring to FIGS. 8A and 8B, the auxiliary air flow constricting valve 30 of the first modification includes a valve housing 31, the substantially cylindrical valve body 32, and the wax-pellet type valve actuating unit 36. The unit 36 consists of a temperature-sensitive portion 33, an expandable and contractible wax-pellet/diaphragm portion 34 and an axially-movable push rod 35 connected to the diaphragm of the wax-pellet/diaphragm portion 34. The valve actuating unit 36 and the valve body 32 are operatively (axially slidably) accommodated in an axial bore 31C defined in the main cylindrical portion of the housing 31. The housing 31 is integrally formed with an auxiliary-air inlet passage 37 and an auxiliary-air outlet passage 38 such that both passages 37 and 38 are slightly offset to each other in the axial direction of the main cylindrical portion of the housing and perpendicular to the axis of the main cylindrical portion. Defined in the main cylindrical portion of the housing 31 is a fluid-flow passage 31A which is communicated with the auxiliary air passage (the bypass passage) through the auxiliary air passages 37 and 38. As clearly seen in FIG. 8A, a cylindrical-hollow valve guide sleeve 49 is press-fitted into the axial bore 31C through the right-hand side opening of the bore and put in place. Actually, the valve body 32 is slidably inserted into and guided by the guide sleeve 49. A return spring 42 is interleaved between the valve body 32 and the plug 31B, such that one end of the spring 42 abuts the left-hand side closed end of the valve body 32 and the other end of the spring 42 abuts the plug 31B. The plug 31B functions to hermetically close the right-hand side opening end of the bore 31C and as a spring seat for the spring 42. The housing 31 is also formed with a coolant passage 39 at its leftmost end. Both ends of the coolant passage 39 are respectively connected to a coolant inlet tube 40 and to a coolant outlet tube 41. The valve actuating unit 36 is disposed in the axial bore 31C at the left-hand side of the valve body 32 so that the temperature-sensitive portion 33 is exposed to the coolant flowing through the passage 39. The push rod 35 is firmly connected to the valve body 32 in such a manner that the rod 35 penetrates the closed end of the valve body 32. The valve body 32 is formed with a circumferentially-elongated slot 32A, whereas the guide sleeve 49 is formed with two substantially rectangular and circumferentially-elongated slots 49*a* and 49*b*, axially spaced to each other. The slot 49*a* has the same width, measured in the circumferential direction, as the slot 49*b*. Also, the slot 32A has a width essentially identical to the width of the respective slots 49*a* and 49*b*. As shown in FIG. 8A, the position relationship between the slots 32A, 49*a* and 49*b* is designed so that the slot 32A of the valve 32 is fully overlapped with only the first slot 49*a* of the two slots 49*a* and 49*b* and the leftmost end of the slot 32A and the leftmost end of the slot 49*a* are aligned with each other with respect to a radial direction perpendicular to the axial direction of the valve, when the engine is cold and thus the wax pellet shrinks in the wax-pellet/diaphragm portion 34. As the sensed coolant temperature T rises, the stroke of the push rod 35 increases. Under the previously-noted condition, when the coolant temperature T rises, on the one hand, the area of the fluid flow passage defined by the slots 32A and 49*a*, overlapping each other, gradually decreases according to the increase in the stroke of the rod 35, and on the other hand the rightmost end of the slot 32A rightwardly axially moves towards the leftmost end of the slot 49*b*. Owing to the rightward axial movement of the push rod 35, when the rightmost end of the slot 32A is aligned with the leftmost end of the slot 49*b*, the fluid-flow area defined by the slots 49*a* and 32A, partially overlapped each other, is adjusted to a predetermined minimum fluid-flow area. When the sensed coolant temperature T further rises, the fluid-flow area defined between the slots 49*a* and 32A gradually decreases to zero from the predetermined minimum fluid-flow area, whereas the fluid-flow area defined by the slots 49*b* and 32A gradually increases to the predetermined minimum fluid-flow area from the zero. As a consequence, when the valve body 32 is held between a first aligned position wherein the leftmost end of the slot 32A is in alignment with the rightmost end of the slot 49*a* and a second aligned position wherein the rightmost end of the slot 32A is in alignment with the leftmost end of the slot 49*b*, the total fluid-flow area is held constant (i.e., at the predetermined minimum fluid-flow area). As can be appreciated, with the valve body 32 positioned between the above-noted first and second aligned positions, the valve body 32 and the guide sleeve 49 are cooperative with each other to maintain the flow rate of auxiliary air passing through the passage 31A at the predetermined minimum flow rate resulting from the predetermined minimum fluid-flow area. Owing to the further risen coolant temperature, the wax pellet further expands and thus the valve body 32 moves rightward from the second aligned position against the bias of the spring 42, with the result that the air flow through the slot 49*a* is completely shut off by the outer peripheral wall of the valve body 32 and additionally the fluid-flow area defined by the slots 49*b* and 32A gradually increases greater than the predetermined minimum fluid-flow area. The valve 30 of the first modification is so designed that the valve body 32 reaches the first aligned position when the sensed coolant temperature reaches the first predetermined temperature T1 and reaches the second aligned position when the sensed coolant temperature reaches the second predetermined temperature T2. Thus, the auxiliary air flow constricting valve 30 of the first modification can provide the previously-noted V-shaped coolant-temperature versus auxiliary air-flow constriction characteristic.

Referring to FIG. 9, there is shown the flow constricting valve of the second modification. Since the basic valve structure of the second modification is similar to that of the first modification shown in FIG. 8A, the same reference numerals used in the first modification of FIG. 8A will be applied to the corresponding elements used in the second modification of FIG. 9. The second modification is different from the first modification in that a poppet-like valve is used. The wax-pellet type valve actuating unit 43 employed in the flow constricting valve of the second modification consists of the temperature-sensitive portion 33, an expandable and contractible wax-pellet/diaphragm portion 46, and an axially movable push rod 44 connected to the diaphragm of the wax-pellet/diaphragm portion 46. As seen in FIG. 9, the poppet-like valve 45 is firmly connected to the tip end of the push rod 44. A spring seat 48 is fixedly provided in the bore defined in the main cylindrical portion of the housing 31 such that a return spring 47 is operatively disposed between the diametrically-enlarged flanged portion of the wax-pellet/diaphragm portion 46 and the spring seat 48. When the engine is cold and thus the wax pellet in the wax-pellet/diaphragm portion 46 shrinks, the rod 44 connected to the diaphragm of the wax-pellet/diaphragm portion 46 is maintained at the leftmost position (the spring-loaded position) indicated in FIG. 9. The spring seat 48 is formed with a fluid-flow constricting central bore 48A having a cross section indicated in FIG. 9. As may be appreciated from FIG. 9, when the poppet-like valve 45 is positioned in the leftmost position, the area of an essentially annular fluid-flow passage defined between the outer periphery of the poppet-like valve 45 and the inner periphery of the bore 48A is a comparatively great. When the engine coolant begins to warm up and the coolant temperature rises gradually, the rod 44 and the valve 45 moves rightward owing to expansion of the wax pellet. As a result, the fluid-flow passage area decreases gradually to a predetermined minimum passage area. The valve of the second modification is so designed that the minimum passage area is reached when the sensed coolant temperature T reaches the first predetermined temperature T1. As seen in FIG. 9, since the poppet-like valve 45 has an essentially cylindrical large-diameter portion having a predetermined axial length, the passage area defined between the valve 45 and the seat 48 is held constant (at the minimum passage area) during the rightward stroke of the rod 44, which stroke is equivalent to the above-noted predetermined axial length from the time when the minimum passage area has been reached. Thereafter, when the sensed coolant temperature further rises greater than the second predetermined temperature T2, the passage area increases again from the minimum passage area. Therefore, the poppet-like valve 45 and the spring seat 48 with the bore 48A are cooperative with each other to function as a variable orifice. Depending the previously-noted axial length of the cylindrical portion of the popper-like valve 45, interrelated to the two predetermined temperatures T1 and T2, the passage area defined between the valve 45 and the spring seat 48 can be set at the minimum passage area in the ease of the sensed coolant temperature T is held between the predetermined temperatures T1 and T2. That is, the flow constricting valve of the second modification can provide the maximum orifice-constriction effect within a predetermined temperature range of $T1<T\leqq T2$. Accordingly, the valve of the second modification can provide the previously-noted V-shaped coolant-temperature versus auxiliary air-flow constriction characteristic.

In the previously-discussed first and second modifications, the valve housing is substantially cylindrical. With respect to the central axis of the substantially cylindrical valve housing, the valve body (32; 45) and the wax-pellet type valve actuating unit (36; 43) are axially aligned with each other, and additionally the valve body and the push rod (35; 44) are coaxially arranged with each other and partially overlapped each other. The flow constricting valve of the valve structure shown in FIGS. 8A or 9 can be small-sized in comparison with the valve structure shown in FIG. 5, thus ensuring a high installation efficiency of the flow constricting valve and also enhancing a degree of freedom of layout or design of the auxiliary air flow control system.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. An auxiliary air flow control system for an internal combustion engine, comprising:

an auxiliary air passage arranged parallel to an intake-air passage and bypassing a throttle valve disposed in said intake-air passage, for diverting a part of intake air from an upstream side of said throttle valve to a downstream side of said throttle valve as an auxiliary air;

an auxiliary air flow control valve disposed in said auxiliary air passage and responsive to operating conditions of the engine for producing therethrough a controlled flow rate of said auxiliary air;

auxiliary-air-flow constricting means being sensitive to a coolant temperature of engine coolant circulating the engine, for constricting said controlled flow rate of said auxiliary air from said auxiliary air flow control valve; and said auxiliary-air-flow constricting means having a valve structure in which a constricting amount of said auxiliary air is increased in accordance with an increase in said coolant temperature when said coolant temperature is below a first predetermined temperature, and held at a predetermined maximum constricting amount when said coolant temperature is within a predetermined temperature range defined by said first predetermined temperature and a second predetermined temperature greater than said first predetermined temperature, and decreased from said predetermined maximum constricting amount in accordance with the increase in said coolant temperature when said coolant temperature rises greater than said second predetermined temperature.

2. An auxiliary air flow control system as set forth in claim 1, wherein said auxiliary-air-flow constricting means comprises a pair of parallel branch passages which passages are branched from said auxiliary air passage downstream of said auxiliary air flow control valve and connected in common to said intake-air passage downstream of said throttle valve, and a pair of auxiliary air flow constricting valves fluidly disposed in the respective branch passages.

3. An auxiliary air flow control system as set forth in claim 2, wherein a first flow constricting valve of said auxiliary air flow constricting valves has a coolant-temperature versus auxiliary air-flow constriction characteristic according to which a constricting amount of auxiliary air flowing through said first flow constricting valve is increased in accordance with the increase in said coolant temperature until said first predetermined temperature has been reached, and held constant at a first predetermined maximum constricting amount after said first predetermined temperature has been reached, and wherein a second flow constricting valve of said auxiliary air flow constricting valves has a coolant-temperature versus auxiliary air-flow constriction characteristic according to which a constricting amount of auxiliary air flowing through said second flow constricting valve is held constant at a second predetermined maximum constricting amount until said second predetermined temperature has been reached, and increased in accordance with the increase in said coolant temperature after said second predetermined temperature has been reached.

4. An auxiliary air flow control system as set forth in claim 3, wherein the constricting amount of auxiliary air flowing through said first flow constricting valve is increased linearly in accordance with the increase in said coolant temperature until said first predetermined temperature has been reached, and the constricting amount of auxiliary air flowing through said second flow constricting valve is increased linearly in accordance with the increase in said coolant temperature after said second predetermined temperature has been reached.

5. An auxiliary air flow control system as set forth in claim 1, wherein said auxiliary-air-flow constricting means comprises a single auxiliary air flow constricting valve fluidly disposed in said auxiliary air passage downstream of and in series to said auxiliary air flow control valve.

6. An auxiliary air flow control system as set forth in claim 5, wherein said single auxiliary air flow constricting valve includes a wax-pellet type temperature-sensitive valve.

7. An auxiliary air flow control system as set forth in claim 5, wherein said single auxiliary air flow constricting valve comprises a valve housing with a fluid-flow passage communicating with said auxiliary air flow passage, a valve body disposed in said fluid-flow passage for variably adjusting an area of said fluid-flow passage, and a valve actuating unit, said valve actuating unit including a temperature-sensitive portion for sensing said coolant temperature, a push rod connected to said valve body for actuating said valve body, and a rod-position adjustment portion responsive to said coolant temperature sensed by said temperature-sensitive portion for adjusting an axial position of said push rod.

8. An auxiliary air flow control system as set forth in claim 7, wherein said valve housing is substantially cylindrical, and said valve body and said valve actuating unit are axially slidably disposed in an axial bore defined in said valve housing so that said valve body and said valve actuating unit are axially aligned with each other.

9. An auxiliary air flow control system as set forth in claim 7, wherein said valve body and said push rod are coaxially aligned with each other and partially overlapped each other.

* * * * *